United States Patent [19]

Renner et al.

[11] Patent Number: 4,656,125

[45] Date of Patent: Apr. 7, 1987

[54] PHOTOGRAPHIC RECORDING MATERIAL

[75] Inventors: Günter Renner, Bergisch Gladbach; Werner Liebe, Leverkusen, both of Fed. Rep. of Germany

[73] Assignee: Agfa Gevaert Aktiengesellschaft, Leverkusen, Fed. Rep. of Germany

[21] Appl. No.: 776,677

[22] Filed: Sep. 16, 1985

[30] Foreign Application Priority Data

Sep. 27, 1984 [DE] Fed. Rep. of Germany ..... 3435443

[51] Int. Cl.[4] ..... G03C 1/40

[52] U.S. Cl. ..... 430/551; 430/372

[58] Field of Search ..... 430/551, 556, 557, 214, 430/372

[56] References Cited

U.S. PATENT DOCUMENTS

| | | | |
|---|---|---|---|
| 3,519,429 | 7/1970 | Lestina | 430/551 |
| 4,366,226 | 12/1982 | Hamaoka et al. | 430/551 |
| 4,562,146 | 12/1985 | Masuda et al. | 430/551 |

*Primary Examiner*—Richard L. Schilling
*Attorney, Agent, or Firm*—Connolly and Hutz

[57] ABSTRACT

Compounds having a structure corresponding to the following formula.

wherein

G represents OH or a precursor group which is unstable to alkali,

X represents a substituent which cannot be split off,

Y represents —O—alkyl, $—SO_2—NR^1—R^2$, $—CO—NR^1—R^2$, $—NR^1—CO—R^3$, or $—NR^1—SO_2—R^3$, $R^1$ represents H or alkyl, $R^2$ represents alkyl, aralkyl or aryl, $R^3$ represents alkoxy, aroxy, alkylamino, arylamino or $R^2$, Z represents H, alkyl, alkoxy, halogen or acylamino and n represents 1 or 2 are suitable for improving the stability to light of image dyes produced from photographic couplers, in particular yellow couplers.

1 Claim, No Drawings

PHOTOGRAPHIC RECORDING MATERIAL

This invention relates to a photographic recording material having at least one silver halide emulsion layer and containing novel light protective agents for the image dyes produced in chromogenic development, in particular for yellow or magenta azomethine dyes.

It is known to produce colour photographic images by chromogenic development, i.e. by the development of image-wise exposed silver halide emulsion layers by means of suitable colour producing developer substances, the so called colour developers, in the presence of suitable colour couplers, the oxidation product of developer substances produced in correspondence with the silver image reacting with the colour coupler to form a dye image. The colour developers used are generally aromatic compounds containing primary amino groups, in particular compounds of the p-phenylene diamine series.

It is also known that image dyes produced by chromogenic development differ in the extent to which they undergo certain changes in response to environmental conditions. This characteristic is particularly marked in their response to the action of light. It is well known that magenta dyes produced from pyrazolone couplers undergo particularly severe bleaching under the action of light whereas cyan dyes produced from phenolic couplers are particularly stable in this respect.

There has been no lack of attempts to provide special measures to overcome this difficulty. In particular, in the case of magenta couplers some improvement in the stability to light has been achieved by the addition of light stabilizing agents or by the use of special couplers. The light stabilizing agents used are mainly phenolic compounds, in particular derivatives of hydroquinone, which are either added to the couplers as admixtures or linked to the coupler molecule in the form of substituents (DE-Pat. No. 1,547,803, DE-Pat. No. 2,617,826, DE-A-Pat No. 2,952,511, JP-Pat. No. 53,070,822, JP-Pat. No. 54,070,830 and JP-Pat. No. 54,073,032).

When it thus became possible to improve the stability to light of magenta dyes produced from pyrazolone couplers and bring it closer to that of cyan dyes, it became increasingly important also to improve the stability of the yellow azomethine dyes so that the prolonged action of light on colour photographs which initially have balanced colours would not cause uneven bleaching of the dyes and thus produce a colour tinge. The means proposed for improving the stability to light of magenta dyes are only suitable to a limited extent for stabilizing yellow dyes and in many cases also have other disadvantages which would make them appear to be little suited for practical use. Hydroquinones and hydroquinone derivatives are readily oxidized and frequently give rise to undesirable discolouration, (yellowing) of the image whites. On prolonged storage, they are frequently oxidized by atmospheric oxygen or other oxidizing agents and thereby lose their effectiveness.

it is an object of the present invention to provide new light protective agents for photographic recording materials, in particular agents which are suitable for improving the stability to light of yellow image dyes produced from yellow couplers.

The present invention relates to a colour photographic recording material having at least one silver halide emulsion layer and a colour coupler associated therewith, characterised in that it contains, in a silver halide emulsion layer or in a light insensitive layer of binder adjacent thereto, a combination of a colour coupler and a compound corresponding to the general formula (I):

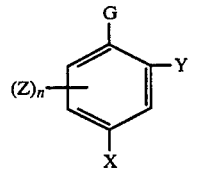

(I)

wherein

G represents a hydroxyl group or an alkali-labile precursor group of a hydroxyl group, X represents a substituent which is not split off under the conditions of chromogenic development, Y represents a group corresponding to one of the following formulae;

O-alkyl, $SO_2$-$NR^1$-$R^2$,

CO-$NR^1$-$R^2$, $NR^1$-CO-$R^3$, $NR^1$-$SO_2$-$R^3$ ($R^1$=hydrogen or alkyl $R^2$=alkyl, aralkyl or aryl, $R^3$=alkoxy, aroxy, alkylamino, arylamino or a group as indicated for $R^2$), Z represents hydrogen, alkyl, alkoxy, halogen or acylamino, and n represents 1 or 2.

Group G is either a hydroxyl group or an alkali labile precursor group of a hydroxyl group, as already mentioned above. The term "alkali labile precursor group of a hydroxyl group" is used to denote a group which undergoes a change under the conditions of alkaline development to form a hydroxyl group. Typical examples are the "acylated hydroxyl groups" which are hydrolysed by alkali in the course of development and split off the blocking acyl group. Blocking acyl groups are derived, for example, from aliphatic or aromatic carboxylic or sulphonic acids; specific examples include acetyl, dichloroacetyl, alkoxycarbonyl and pyruvoyl.

The group X in the formula, which is not split off under the conditions of chromogenic development, may consist, for example, of an alkyl, alkoxy carbonyl, carbamoyl, acylamino, sulphamoyl, alkyl sulphonyl or aryl sulphonyl group. Those groups which under the conditions of chromogenic development, i.e. add pH values from 9 to 12, are not only not split off but also do not confer any tendency to oxidation on the light stabilizing compound under these conditions (e.g. due to secondary products of development) are particularly suitable for this purpose. The above mentioned alkyl groups may be straight chained or branched and may contain up to 18 carbon atoms or more. Examples include methyl, ethyl, t-butyl, 1,1,3,3-tetramethylbutyl, n-dodecyl and n-tridecyl. Such alkyl groups may also be contained in the above mentioned alkoxy carbonyl, carbamoyl, acylamino, sulphamoyl and alkyl sulphonyl groups.

The alkyl groups represented by $R^1$, $R^2$ or Z may be straight chained or branched and may contain up to 20 carbon atoms and may carry further substituents such as, for example, phenoxy groups, which in turn may be substituted by alkyl, alkoxy, hydroxyl or halogen.

Benzyl is an example of an aralkyl group represented by $R^2$; phenyl is an example of an aryl group represented by $R^2$.

An alkoxy or alkylamino group represented by $R^3$ may be a straight chained or branched, optionally substituted alkyl group having up to 20 carbon atoms. An arylamino group represented by $R^3$ may be, for example, an aniline group, which may contain further substituents such as halogen, nitro or alkyl.

Chlorine and bromine are examples of halogen substituents represented by Z. An acylamino group represented by Z may be derived from aliphatic or aromatic carboxylic or sulphonic acids.

Examples of light stabilizing compounds according to the present invention are given below.

S-1

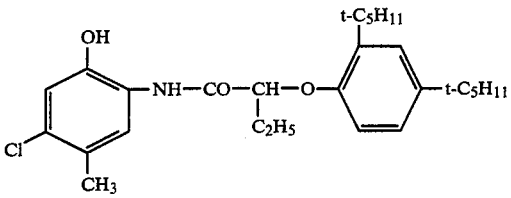

S-2

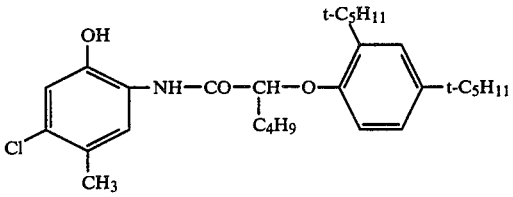

S-3

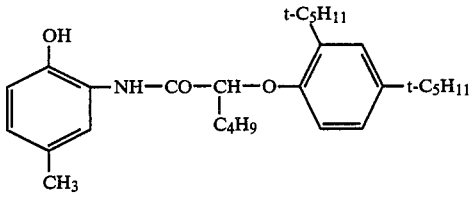

S-4

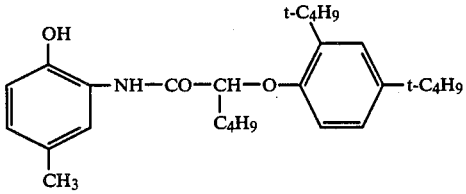

S-5

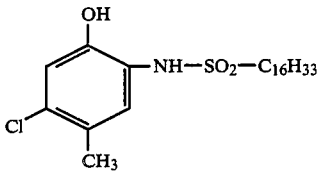

S-6

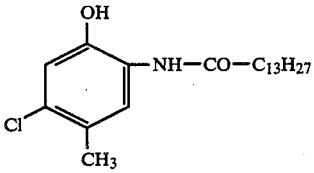

S-7

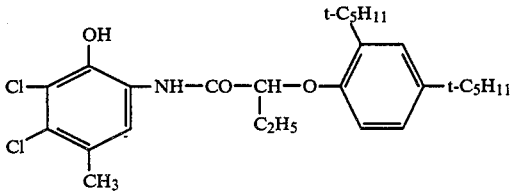

S-8

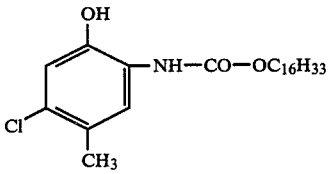

S-9

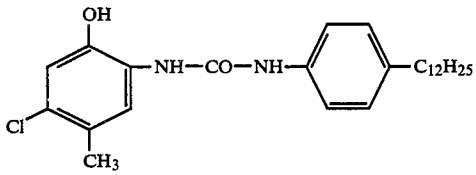

S-10

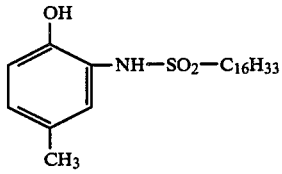

S-11

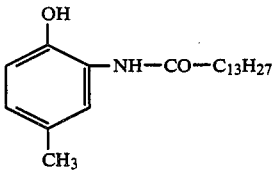

S-12

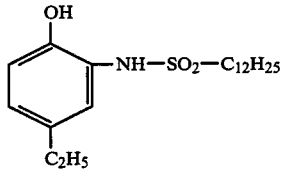

S-13

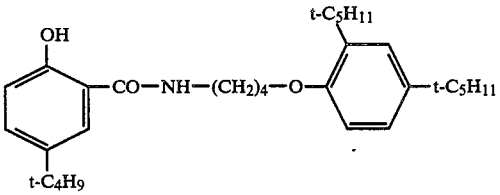

S-14

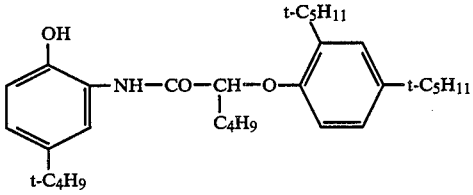

-continued
S-15
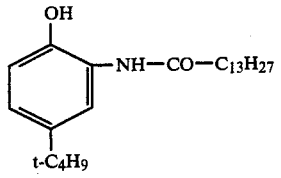
S-16
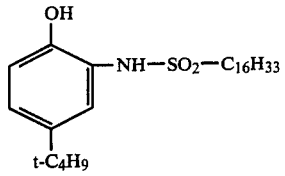
S-17
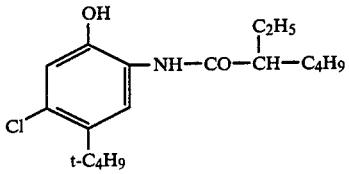
S-18
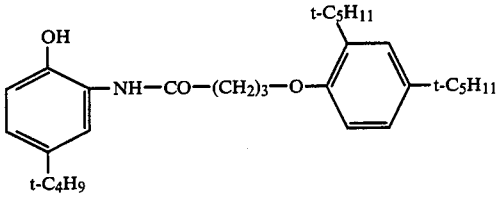
S-19
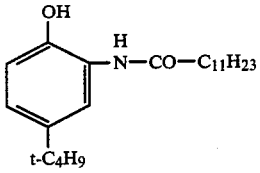
S-20
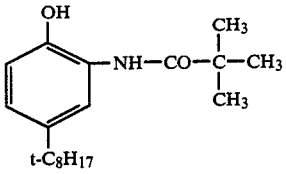
S-21
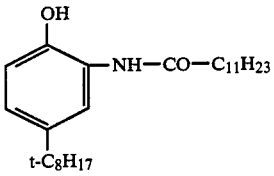
S-22
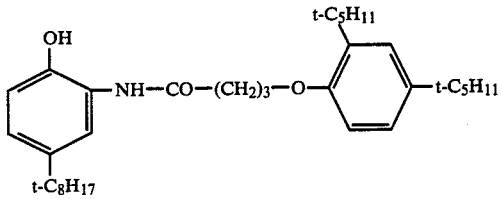
S-23
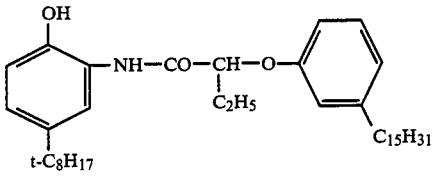
S-24
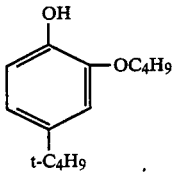
S-25
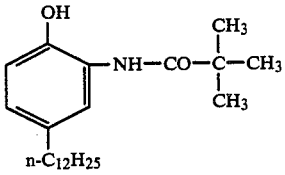
S-26
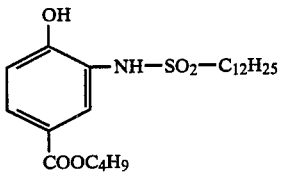
S-27
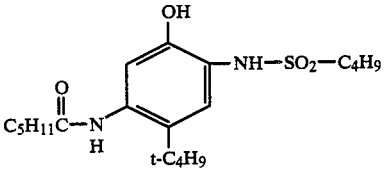
S-28
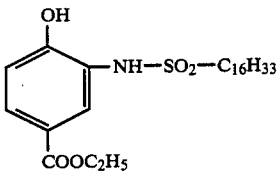
S-29
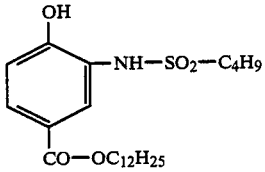
S-30
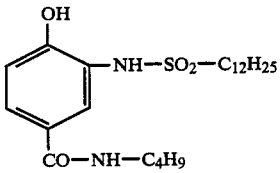

-continued

S-35

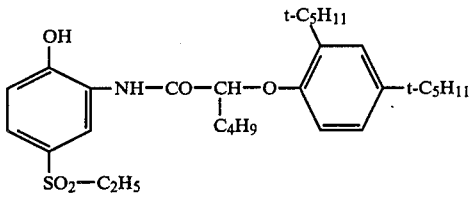

S-36

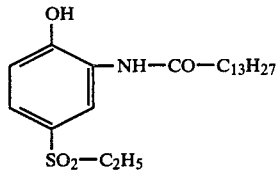

S-37

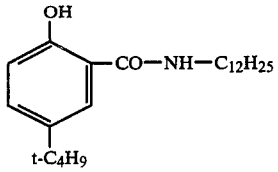

S-38

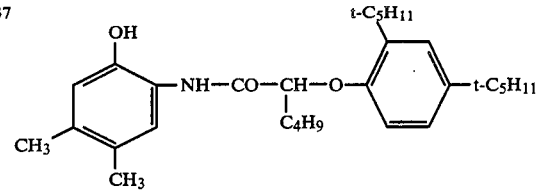

Group t-$C_8C_{17}$ in compounds S-20 to S-23 is an alkyl group having the following structure:

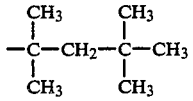

The compounds corresponding to formula I to be used according to the invention may be prepared by known methods, e.g. by acylation or sulphonation of the corresponding o-aminophenols in dipolar aprotic solvents such as dimethyl formamide, dimethylacetamide, hexamethylphosphoric acid triamide, N-methyl pyrrolidone or the like or in dipolar solvents such as acetone, methylethyl ketone or acetonitrile, or in protic solvents such as alcohols with the addition of bases. Examples are given in the following Examples of preparation.

Preparation of Compound S-3

7.3 g of 2-amino-4-methyl phenol are dissolved in 80 ml of acetone and 9.0 ml of N,N-dimethylaniline. 24 g of α-2,4-diamyl-phenoxy caproic acid chloride are slowly added at 0°–5° C. The reaction mixture continues to be stirred for one hour, during which the temperature slowly rises to 20° C., and the mixture is then stirred out into a mixture of ice, water and hydrochloric acid. The product is suction filtered and dried and the residue is recrystallised from acetonitrile, 22 g of pure substance are obtained. 76% yield, Mp: 160° C.

Preparation of compound S-20

11 g of 2-amino-4-tertiary-octyl phenol are dissolved in 50 ml of dimethyl acetamide with 13 ml of triethylamine, 5.6 g of pivaloyl chloride are added at room temperature. After 1 hour, the reaction mixture is stirred out into 200 ml of ice water with 10 ml of concentrated hydrochloric acid. The precipitate is suction filtered, washed with water, dried and recrystallised from acetonitrile, 9 g yield, Mp: 184°–185° C.

The colour photographic recording materials according to the invention in which the compounds according to the present invention may advantageously be used are preferably multilayered materials having several silver halide emulsion layers or emulsion layer units differing in their spectral sensitivity. The emulsion layer units are understood to be laminates of 2 or more silver halide emulsion layers having the same spectural sensitivity.

Associated with each of the above mentioned light sensitive silver halide emulsion layers or emulsion layer units is a colour coupler capable of reacting with colour developer oxidation products to form a non-diffusible dye. The colour couplers are advantageously non-diffusible and accommodated in the light sensitive layer itself or closely adjacent thereto. The colour couplers associated with the 2 or more partial layers of an emulsion layer unit need not necessarily be identical, provided only that they give rise to the same colour on colour development, normally a colour which is complementary to the colour of the light to which the light sensitive silver halide emulsion layers are sensitive.

The red sensitive silver halide emulsion layers therefore each have at least 1 non-diffusible dye coupler associated with them to produce the cyan partial colour image, generally a coupler of the phenol or α-naphthol series. The cyan couplers of the kind mentioned, for example, in U.S. Pat. No. 2,474,293, U.S. Pat. No. 2,367,531, U.S. Pat. No. 2,895,826, U.S. Pat. No. 3,772,002, EP-O Pat. No. 028,099, EP-O Pat. No. 112,514 should be particularly mentioned.

The green sensitive silver halide emulsion layers each contain at least 1 non-diffusible colour coupler for producing the magenta partial colour image, usually a colour coupler of the 5-pyrazolone or indazolone series. Particularly to be mentioned, for example, are the magenta couplers of the kind described in U.S. Pat. No. 2,600,788, U.S. Pat. No. 4,383,027, DE-Pat. No. 1,547,803, DE-Pat. No. 1,810,464, DE-A-Pat. No. 2,408,665 and DE-A-Pat. No. 3,226,163.

The blue sensitive silver halide emulsion layers each contain at least 1 non-diffusible colour coupler for producing the yellow partial colour image, generally a colour coupler having an open chain ketomethylene group. Particularly to be noted, for example, are the yellow couplers described in U.S. Pat. No. 3,408,194, DE-Pat. No. 2,329,587 and DE-Pat. No. 2,456,976.

Colour couplers of these kinds are known in large numbers and have been described in numerous Patent Specifications. Further references may be found, for example, in the publications, "Farbkuppler" by W. Pelz, "Mitteilunger aus den Forschungslaboratorien der Agfa, Leverkusen/Munchen", Volume III (1961) page 111, and by K. Venkataraman in "The Chemistry of Synthetic Dyes", Volume 4, 341 to 387, Academic Press (1971).

The colour couplers may be either conventional 4-equivalent couplers or 2-equivalent couplers which require a smaller quantity of silver halide for producing the colour. 2-equivalent couplers are derived, as is known, from 4-equivalent couplers in that they contain, in the coupling position, a substituent which is split off in the coupling reaction. 2-equivalent couplers suitable for the present invention include both those which are virtually colourless and those which have an intense colour of their own which disappears in the process of colour coupling or is replaced by the colour of the resulting image dye. According to the invention, the last mentioned couplers may be present in addition in the light sensitive silver halide emulsion layers where they may serve as masking couplers to compensate for the unwanted side densities of the image dyes. Also to be counted among the 2-equivalent couplers are the known DIR couplers, which carry a releasable group in the coupling position and which react with colour developer oxidation products to release this group as a diffusible development inhibitor or as a precursor of a development inhibitor.

If required, mixtures of colour couplers may be used to obtain a certain colour shade or certain reactivity. For example, water soluble couplers may be used in combination with hydrophobic, water insoluble couplers.

The same methods may be used for incorporating the couplers in the layers of colour photographic recording material as those used for incorporating the compounds according to the invention. Thus incorporation of hydrophobic colour couplers may suitably be carried out by one of the known emulsification processes in which, for example, the colour coupler is dissolved in an organic solvent, optionally in the presence of a high boiling coupler solvent or oil former, and is then dispersed in a gelatine solution. Dibutyl phthalate and tricresyl phosphate are examples of high boiling coupler solvents. Other coupler solvents are described, for example, in U.S. Pat. No. 2,322,927, U.S. Pat. No. 3,689,271, U.S. Pat. No. 3,764,336 and U.S. Pat. No. 3,765,897.

Alternatively, aqueous dispersions of the hydrophobic couplers may be prepared and added to the appropriate casting solutions. For this purpose, aqueous slurries of the couplers are finely ground by intensive stirring with the addition of sharp sand and/or the use of ultra-sound. See in this connection also DE-Pat. No. 2,609,741.

The compounds according to the invention are preferably used together with yellow couplers although effects are also obtained when they are combined with magenta couplers or cyan couplers. For this purpose, they may be dissolved in an oil former together with the particular colour couplers and added to the casting solution in the form of such a combined solution, or they may be added to the casting solution as a separate solution in an oil former. Advantageous results may be obtained by using the compound according to the invention in a proportion of from 5 to 200% by weight, preferably from 20 to 100% by weight, based on the quantity of colour coupler used.

Compound I and the associated colour coupler are preferably present in the same layer although they could be introduced into adjacent layers.

To stabilize the image dyes produced from the colour couplers, the colour photographic recording material may in addition contain known stabilizers, as for example UV absorbents and agents which prevent or retard the bleaching of dyes, particularly under the action of light, heat or moisture. Compounds which have been described as suitable for this purpose include, for example, phenol derivatives, hydroquinone derivatives, p-alkoxyphenol derivatives, pyrogallol derivatives, gallic acid derivatives, 5-hydroxy coumarone derivatives, 6-hydroxy chroman derivatives and 5-hydroxy indan derivatives.

As already mentioned, the compounds according to the invention are preferably used in combination with yellow couplers. These would mainly be hydrophobic yellow couplers which are readily soluble in hydrophobic or hydrophilic oil formers. The yellow couplers are preferably derived from α-pivaloyl or α-benzoyl acetanilides. Examples of such yellow couplers are given below.

Y-1

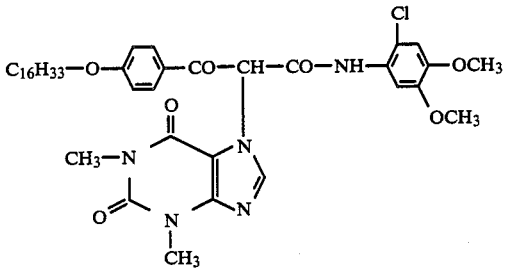

Y-2

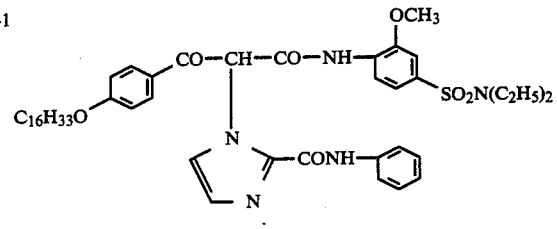

Y-3

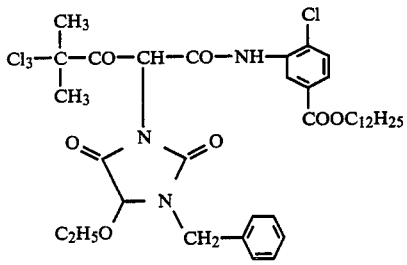

Y-4

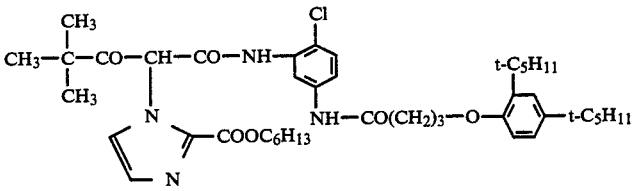

-continued

Y-5

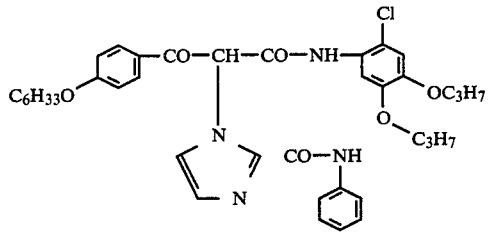

Y-6

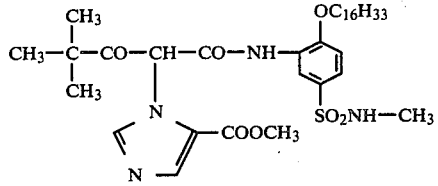

Y-7

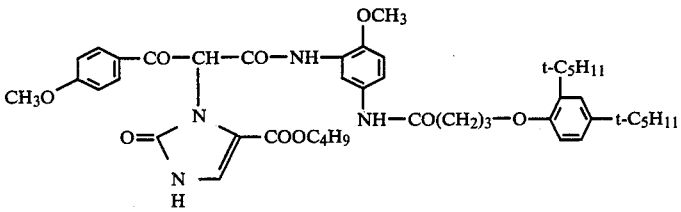

Y-8

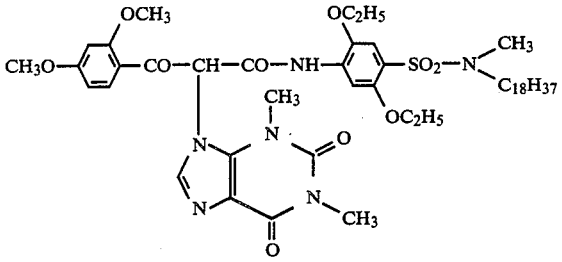

The interlayers which are arranged between the light sensitive silver halide emulsion layers and in which the binder preferably consists of gelatine may contain compounds which are capable of reacting with colour developer oxidation products and thus prevent unwanted diffusion of the colour developer oxidation products. Examples of such compounds include non-diffusible reducing agents, e.g. hydroquinone derivatives, which, when they react with the colour developer oxidation products, do not give rise to a dye which remains in the layers, as well as colour couplers which give rise to a soluble dye which is washed out of the layers in the course of the photographic process. Other suitable compounds for suppressing the unwanted diffusion of colour developer oxidation products have been described, for example, in the monograph, "Stabilization of photographic silver halide emulsions" by E. J. Birr, The Focal Press, 1st Edition 1974, pages 116 to 122.

For other suitable additives to be used in the colour photographic recording materials according to the invention or in one of their layers, see the article in the Journal "Product Licensing Index", Volume 92, December 1971, pages 107 to 110.

The recording materials according to the invention may be developed with the usual colour developer compounds, in particular those of the p-phenylene diamine series containing a primary amino group, e.g. 4-amino-N,N-dimethyl aniline, 4-amino-N,N-diethyl aniline, 4-amino-3-methyl-N,N-diethyl aniline, 4-amino-3-methyl-N-methyl-N-(β-methyl sulphonamidoethyl)-aniline, 4-amino-N-ethyl-N-(β-hydroxyethyl)-aniline, 4-amino-3-methyl-N-ethyl-N-(β-hydroxyethyl)-aniline, 4-amino-3-methyl-N-ethyl-N-(β-methoxy ethyl)-aniline, 4-amino-3-methyl-N-ethyl-N-(β-methyl sulphonamidoethyl)-aniline, 4-amino-N-butyl-N-(ω-sulphobutyl)-aniline, and 4-amino-3-methyl-N-isopropyl-N-(ω-sulphobutyl)-aniline.

Other suitable colour developers have been described in J.Amer. Chem. Soc., 73, 3200–3125 (1951).

EXAMPLE 1

Colour photographic recording materials were prepared as follows.

(a) Preparation of the colour coupler emulsions.

8 mmol of colour coupler are dissolved in their own weight of dibutyl phthalate and three times their weight of ethyl acetate in the presence of 0.15 g of sulphosuccinic acid dioctyl ester at a temperature of 50° C. to 75° C. In addition, the light stabilizing compound to be tested is in some cases added in the quantity shown in the Table. The solution is then stirred into 150 g of 7.5% aqueous gelatine solution at a temperature of about 40° C. and dispersed in this solution.

(b) Preparation of the colour photographic recording materials to be tested.

The emulsion prepared under (a) is mixed with a silver halide emulsion containing 8.2 g of silver in the form of silver halide, 9.2 g of gelatine and 0.04 g of sodium dodecyl benzene sulphonate. The total volume is adjusted to 350 ml with water. The casting solution prepared as described is cast on a layer support of cellulose triacetate.

(c) Processing and assessment.

After drying, the material is exposed behind a step wedge and colour developed in the usual manner.

The processed samples, covered with a UV protective foil, are then irradiated in a xeno test apparatus to determine the fastness to light (40% relative humidity, 25° C., 100,000 lux hours). The UV protective foil had been prepared as follows: A layer of 1.5 g of gelatine, 0.65 g of compound A (UV absorbent) corresponding to the following formula:

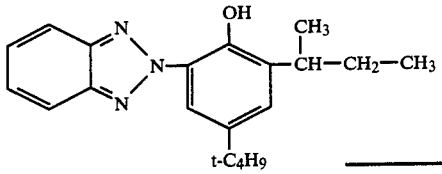

Developer A contains 2-amino-5-(N-ethyl-N-methanesulphonamidoethylamino)-toluene as colour developer substance. Developer B contains 2-amino-5-(N-ethyl-N-hydroxy ethylamino)-toluene as colour developer substance. The results (percentage reduction in colour density) are entered in Table 1.

TABLE 1

| | | Density loss (%) | | | | | |
|---|---|---|---|---|---|---|---|
| | | Developer A | | | Developer B | | |
| Coupler | Additive (25%)* | D = 0.5 | D = 1.0 | D max | D = 0.5 | D = 1.0 | D max |
| Y-1 | — | 48 | 35 | 9 | 72 | 64 | 61 |
| | S-3 | 36 | 26 | 8 | 44 | 42 | 39 |
| | S-4 | 29 | 22 | 7 | — | — | — |
| | S-10 | 18 | 15 | 5 | 50 | 46 | 42 |
| | S-16 | 24 | 18 | 8 | 48 | 42 | 35 |
| | S-20 | 32 | 22 | 8 | 46 | 39 | 30 |
| | S-35 | 38 | 28 | 6 | 54 | 50 | 47 |
| Y-2 | — | 52 | 38 | 12 | 68 | 62 | 44 |
| | S-3 | 38 | 30 | 7 | 47 | 41 | 30 |
| | S-4 | 38 | 32 | 8 | — | — | — |
| | S-10 | 42 | 33 | 6 | 32 | 30 | 25 |
| | S-16 | 40 | 28 | 9 | 36 | 36 | 32 |
| | S-20 | 20 | 16 | 9 | 40 | 32 | 18 |
| | S-35 | — | — | — | 60 | 42 | 16 |
| Y-3 | — | 30 | 27 | 13 | 68 | 76 | 60 |
| | S-3 | 19 | 12 | 10 | 54 | 52 | 45 |
| Y-4 | — | 32 | 15 | 11 | 24 | 14 | 5 |
| | S-1 | 16 | 8 | 6 | — | — | — |
| | S-3 | 12 | 6 | 7 | 19 | 8 | 4 |
| | S-4 | 18 | 10 | 6 | — | — | — |
| | S-10 | 10 | 7 | 4 | 12 | 6 | 3 |
| | S-16 | 6 | 6 | 4 | — | — | — |
| | S-20 | 12 | 12 | 2 | — | — | — |
| | S-35 | 12 | 8 | 3 | 18 | 12 | 5 |
| Y-5 | — | 40 | 30 | 13 | 70 | 68 | 60 |
| | S-3 | 24 | 22 | 11 | 52 | 48 | 45 |
| Y-6 | — | 22 | 20 | 10 | — | — | — |
| | S-3 | 22 | 20 | 10 | — | — | — |
| Y-7 | — | 32 | 28 | 22 | 52 | 40 | 27 |
| | S-3 | 18 | 17 | 11 | 24 | 26 | 18 |
| | S-4 | 30 | 24 | 10 | — | — | — |
| | S-10 | 28 | 24 | 10 | 32 | 28 | 17 |
| | S-16 | 30 | 26 | 13 | 36 | 30 | 14 |
| | S-20 | 28 | 22 | 11 | 40 | 26 | 12 |
| | S-35 | 32 | 23 | 9 | 48 | 36 | 17 |
| Y-8 | — | 18 | 14 | 13 | 24 | 18 | 9 |
| | S-3 | 8 | 6 | 9 | 14 | 13 | 4 |

*Based on the quantity of yellow coupler used.

0.07 g of dioctyl hydroquinone and 0.36 g of tricresyl phosphate was applied to a transparent cellulose triacetate film covered with an adhesive layer. The quantities given are based on 1 $m^2$.

EXAMPLE 2

The procedure was as described in Example 1. For comparison, the following compounds, which are known light stabilizing agents for magenta dyes produced from pyrazolone couplers, were also tested.

V-1

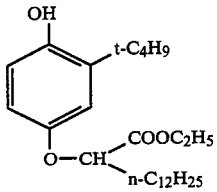

V-2

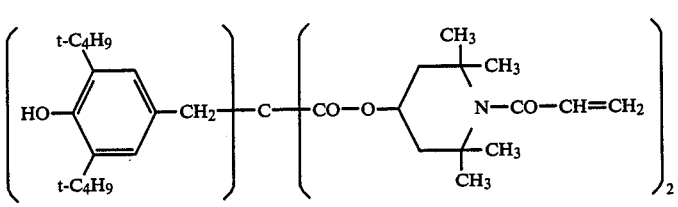

V-3

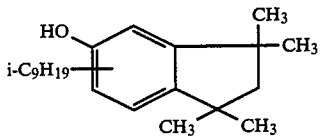

V-4

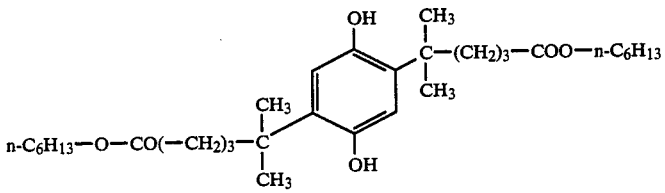

V-5

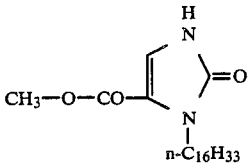

-continued

V-6

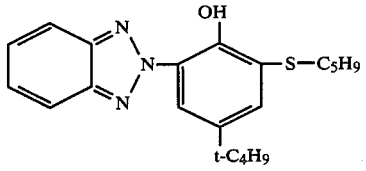

Compound Y-4 was used as coupler. The results obtained with developer A are shown in the following table 2.

TABLE 2

| Additive | Quantity (%)* | Density loss (%) D = 0.5 | D = 1.0 | D max |
|---|---|---|---|---|
| — | — | 32 | 15 | 11 |
| V-1 | 50 | 30 | 24 | 21 |
| V-2 | 25 | 20 | 10 | 8 |
| V-2 | 50 | 12 | 9 | 5 |
| V-3 | 50 | 37 | 26 | 17 |
| V-4 | 50 | 80 | 80 | 80 |
| V-5 | 25 | 32 | 14 | 12 |
| V-6 | 50 | 33 | 19 | 14 |
| S-3 | 25 | 12 | 6 | 7 |
| S-3 | 50 | 10 | 6 | 5 |
| S-20 | 25 | 12 | 12 | 2 |

*Based on the quanity of yellow coupler Y-4.

Stabilisation of magenta and cyan dyes.

The procedure was the same as in Example 1.

The following colour couplers were used:

M-1

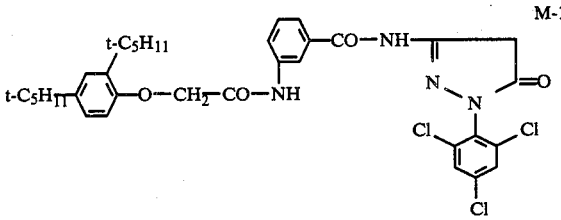

C-1

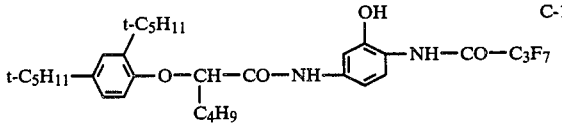

C-2

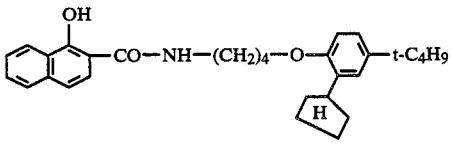

The results are shown in Table 3.

TABLE 3

| Coupler | Additive (25%) | Density loss (%) Developer A D = 0.5 | D = 1.0 | D max | Developer B D = 0.5 | D = 1.0 | D max |
|---|---|---|---|---|---|---|---|
| M-1 | — | 68 | 72 | 49 | 72 | 82 | 69 |
| M-1 | S-3 | 48 | 46 | 38 | 64 | 60 | 46 |
| C-1 | — | 24 | 20 | 12 | 24 | 26 | 25 |
| C-1 | S-3 | 24 | 18 | 9 | 20 | 26 | 26 |
| C-2 | — | 20 | 6 | 2 | 12 | 14 | 10 |
| C-2 | S-3 | 16 | 10 | 3 | 12 | 10 | 7 |

It can be seen from Table 3 that compound S-3 also has a certain stabilising effect on the light fastness of magenta and cyan dyes. This effect is, of course, comparitively slight in the case of the cyan dyes, which are intrinsically more stable.

EXAMPLE 4

The following layers were applied in succession to a polyethylene coated paper covered with adhesive layer (the quantities given are based on 1 $m^2$).

1. A blue sensitive silver halide emulsion layer containing yellow coupler and prepared from 0.55 g of $AgNO_3$ with 0.72 g of compound Y-4, 0.22 g of tricresyl phosphate and 1.7 g of gelatine.
2. An interlayer containing 1.2 g of gelatine, 0.07 g of dioctyl hydroquinone and 0.04 g of tricresyl phosphate.
3. A green sensitized silver halide emulsion layer containing magenta coupler and prepared from 0.5 g of $AgNO_3$ with 0.45 g of compound M-2 (magenta coupler), corresponding to the following formula:

M-2

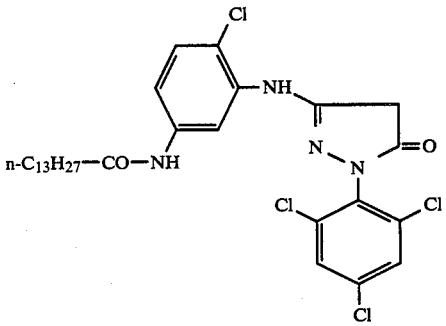

0.22 g of compound V-1 as light stabilizer, 0.36 g of dibutyl phthalate and 1.5 of gelatine.

4. A UV protective layer containing 1.5 g of gelatine, 0.65 g of Compound A (UV absorbent), 0.07 g of dioctyl hydroquinone and 0.36 g of tricresyl phosphate.
5. A red sensitized silver halide emulsion layer containing cyan coupler and prepared from 0.4 g of $AgNO_3$ with 0.35 g of compound C-3 as cyan coupler corresponding to the following formula:

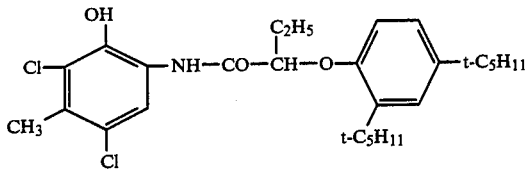

0.14 g of dibutyl phthalate and 1.4 g of gelatine.

6. A covering layer containing 1.2 g of gelatine.

The material is hardened by coating it with a 10% aqueous solution of an instant hardener.

Recording material 1, is thus obtained. Recording material 2, is prepared similarly, with the only difference that layer 1 in addition contains 0.22 g of compound S-3.

Material 1 (state of the art) and material 2 (according to the invention) were both exposed to blue light behind a step wedge and developed as follows (bath temperature 33° C.):

1. Colour development 3.5 min.
   15 ml of benzyl alcohol,
   -ml of ethylene glycol,
   3 g of hydroxylamine sulphate,
   4.5 g of 3-methyl-4-amino-N-ethyl-N-(β-methane sulphonamidoethyl)-aniline sulphate,
   32 g of $K_2CO_3$,
   2 g of $K_2SO_3$,
   0.6 g of KBr and
   1 g of the disodium salt of 1-hydroxy ethylidine-1,1-disulphonic acid
   made up with water to 1000 ml; pH 10.2.
2. Bleach fixing bath—1.5 minutes.
   35 ml of ammonia solution (28%),
   30 g of EDTA,
   15 g of $Na_2SO_3$,
   100 g of ammonium thiosulphate, and
   60 g of sodium-(EDTA)-iron-III complex
   made up with water to 1000 ml; pH 7.
3. Washing—3 minutes.

The yellow colour portions obtained were measured and the density stages 0.8 and 1.0 were marked. The wedges were then exposed to a quantity of light of $15\times10^6$ lux hours in a xeno test apparatus. The marked stages were again measured. The results were shown in the table.

TABLE 4

| Material | $\frac{D}{Do}$ in [%] at D = 1.0 | D = 0.8 |
|---|---|---|
| 1 (without additive) | 36 | 48 |
| 2 (with compound S-2) | 23 | 27 |

The additive according to the invention thus reduces the colour density loss by about 40%.

We claim:

1. A color photographic recording material comprising at least one silver halide emulsion layer and a color coupler associated therewith, comprising, in a silver halide emulsion layer or in a light insensitive layer of binder adjacent thereto, a combination of a yellow coupler and a compound corresponding to the general formula I:

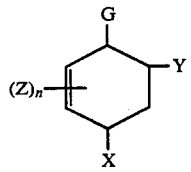

wherein

G represents a hydroxyl group or an alkali labile precursor group of a hydroxyl group, X represents an alkyl, alkoxy carbonyl, carbamoyl, sulphamoyl, alkyl sulfonyl or aryl sulphonyl group which is a substituent which is not split off under the conditions of chromogenic development, Y represents a group corresponding to one of the following formula:
O-alkyl,
$SO_2$-$NR^1$-$R^2$,
CO-$NR^1$-$R^2$,
$NR^1$-CO-$R^3$, or
$NR^1$-$SO_2$-$R^3$
$R^1$=hydrogen or alkyl,
$R^2$=alkyl, aralkyl or aryl, and
$R^3$=alkoxy, aroxy, alkylamino, arylamino or a group as indicated for $R^2$;

Z represents hydrogen, alkyl, halogen or acylamino; and n represents 1 or 2.

* * * * *